US005313241A

United States Patent [19]

Seim

[11] Patent Number: 5,313,241

[45] Date of Patent: May 17, 1994

[54] PROCESSOR DIAGNOSTICS USING SWITCH SETTINGS

[75] Inventor: April M. Seim, Spencerport, N.Y.

[73] Assignee: Eastman Kodak Company, Rochester, N.Y.

[21] Appl. No.: 981,807

[22] Filed: Nov. 25, 1992

[51] Int. Cl.[5] ..... G03D 13/00

[52] U.S. Cl. ..... 354/298; 354/324

[58] Field of Search ..... 354/298, 324; 355/205-209

[56] References Cited

U.S. PATENT DOCUMENTS

| | | | |
|---|---|---|---|
| 3,995,959 | 12/1976 | Shaber | 354/298 |
| 4,162,396 | 7/1979 | Howard et al. | 355/206 X |
| 4,204,253 | 5/1980 | van den Hanenberg | 364/200 |
| 4,757,463 | 7/1988 | Ballou et al. | 364/551 |
| 4,885,705 | 12/1989 | Choi | 354/321 X |
| 4,888,771 | 12/1989 | Benignus et al. | 371/16.1 |
| 4,994,837 | 2/1991 | Samuels et al. | 354/299 |
| 4,994,840 | 2/1991 | Hall et al. | 354/324 |
| 5,010,551 | 4/1991 | Goldsmith et al. | 355/206 X |
| 5,020,011 | 5/1991 | Stark et al. | 364/580 |
| 5,023,643 | 6/1991 | Lynch et al. | 355/324 X |
| 5,073,499 | 12/1991 | Bellows | 436/50 |
| 5,081,598 | 1/1992 | Bellows et al. | 364/550 |
| 5,107,499 | 4/1992 | Lirov et al. | 371/15.1 |
| 5,127,012 | 6/1992 | Hiliger | 355/206 X |
| 5,130,936 | 7/1992 | Sheppard et al. | 364/551.01 |
| 5,189,455 | 2/1993 | Seim | 354/324 X |
| 5,189,456 | 2/1993 | Sherburne et al. | 354/298 |

*Primary Examiner*—D. Rutledge

*Attorney, Agent, or Firm*—William F. Noval

[57] ABSTRACT

A processor for developing latent images on a photosensitive material includes at least one processing station wherein a processing solution engages the photosensitive material, and a drying station at which the photosensitive material is dried, means for initiating a plurality of diagnostic tests for activating components of the processor, a controller coupled to the components of the processor for selectively activating one or more of the components according to a selected one of a plurality of predetermined diagnostic tests, a plurality of switches connected to the controller for selecting from among the plurality of diagnostic tests, and an initiator for starting the selected test a predetermined time after the switches are set.

12 Claims, 2 Drawing Sheets

PROCESSOR DIAGNOSTICS USING SWITCH SETTINGS

This invention relates generally to film processing apparatus, and more particularly to a method and apparatus for initiating preselected diagnostic testing sequences in film processing apparatus using low cost selection switches.

There is a need for low cost reliable processors for developing latent images on photo sensitive and x-ray sensitive film. If truly low cost easy to operate processors can be provided, they can be installed in large numbers close to the locations where the film is exposed, and is later read by users rather than being limited to less convenient processing centers.

Many improvements in film processing apparatus have been made, including improvements in the apparatus itself and the control systems for the apparatus. Modern film processing apparatus usually includes a microprocessor for controlling the various elements of the apparatus including heaters, fans, motors, pumps and the like.

Although the use of microcomputers to control film processors has a number of advantages including reducing the cost of the processors and increasing their effectiveness, these integrated control systems make trouble shooting of processors more difficult than was the case when electromechanical controllers were employed and the state of a motor, for example, could be determined by mechanically closing the relay used to control the motor.

Trouble shooting inoperative systems in film processors often requires selectively activating one or more processor systems, such as a motor, to determine whether, for example, the failure of a motor to run is due to a motor failure, or some other failure in the system. Microprocessors are particularly well suited to the transfer of information and instructions through serial ports, and known film processors have utilized such serial ports to connect external microcomputers or controllers for instituting diagnostic procedures and evaluating the procedures. Though effective, this technique is expensive and therefore not ideally suited to low cost film processors.

Accordingly, it is an object of this invention to provide a method and apparatus for initiating diagnostic procedures in a film processor that are less expensive than the methods an apparatus previously used.

It is another object of this invention to provide apparatus for initiating diagnostic tests that uses no more than simple inexpensive switches that can be easily set by a service person to start the desired test.

It is still another object of this invention to provide a film processor in which the diagnostic testing procedures are controlled by computer software in connection with the existing film processor controller microprocessor, and are only selected by switches, so that substantially the entire additional cost of implementing the diagnostic procedures is related to the development of the software. The only additional hardware cost is the additional of a very inexpensive selector switch.

Briefly stated, and in accordance with a presently preferred aspect of the invention, a processor for developing latent images on a photosensitive material includes at least one processing station wherein a processing solution engages the photosensitive material, and a drying station at which the photosensitive material is dried, means for initiating a plurality of diagnostic tests for activating components of the processor, control means coupled to the components of the processor for selectively activating one or more of the components according to a selected one of a plurality of predetermined diagnostic tests, switch means connected to the control means for selecting from among the plurality of diagnostic tests, and initiation means for starting the selected test a predetermined time after the switch means are set.

In accordance with another aspect of this invention, the control means comprises a programmed microprocessor and interface means are connected between the microprocessor and the components, for activating the components upon receiving activation signals from the microprocessor.

In accordance with another aspect of this invention, the switch means comprises a plurality of switches connected to the microprocessor and the selection of the diagnostic test depends upon the setting of the plurality of switches.

In accordance with yet another aspect of this invention, the switches comprise single pole single throw switches.

In accordance with still another aspect of this invention, the switches are arranged to signal a binary code designating the predetermined diagnostic test, and the microprocessor reads the binary code from the switches.

In accordance with a still further aspect of this invention, a switch is provided for selecting between a diagnostic mode and a normal mode.

In accordance with a still further aspect of the invention, the control means includes means responsive to the switch means for terminating a diagnostic test and resetting the initiation means when the switch means is changed during a test to select another diagnostic test.

In accordance with a still further aspect of the invention, the processor includes a plurality of sensors and a plurality of indicators, and the plurality of diagnostic tests includes at least one test in which the indicators are configured to indicate the status of the sensors.

BRIEF DESCRIPTION OF THE DRAWING

The novel aspects of the invention are set forth with particularity in the appended claims. The invention itself, together with further objects and advantages thereof may be more fully understood by referring to the following description of a presently preferred embodiment of the invention taken in conjunction with the accompanying drawing, in which:

DETAILED DESCRIPTION OF THE INVENTION

Figure 1:
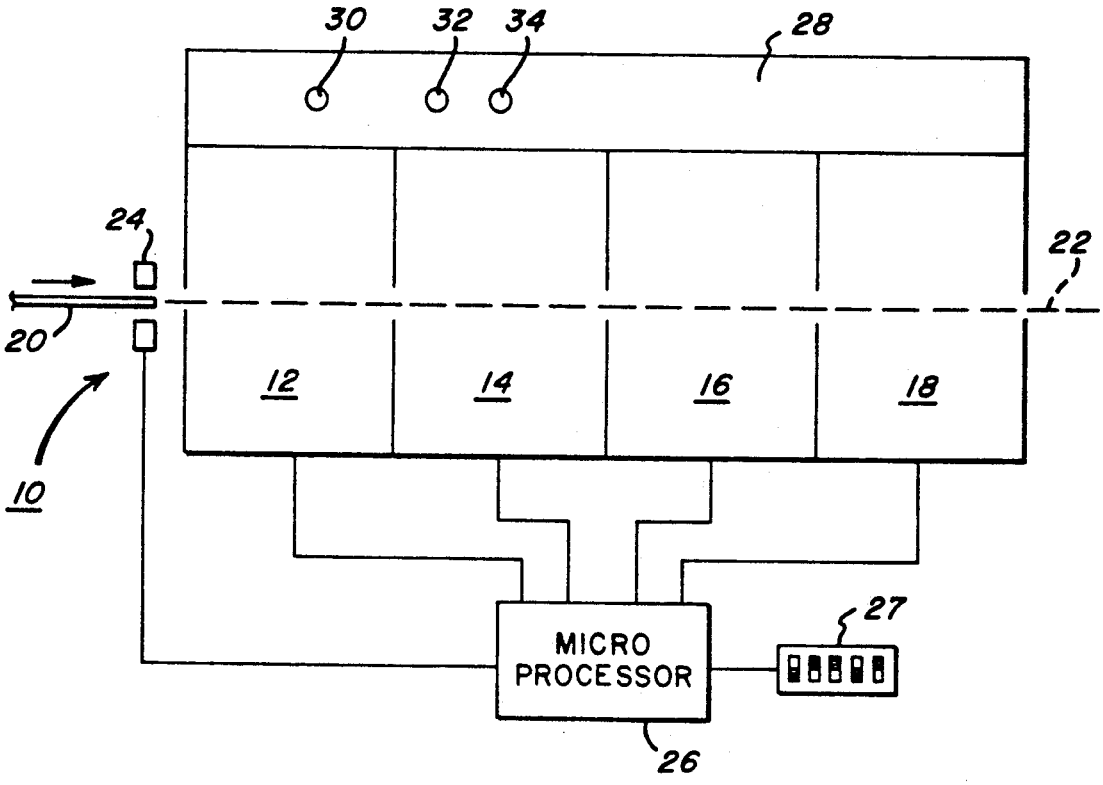
FIG. 1 is a diagrammatic view of portions of a film processor in accordance with the present invention.

A film processor in accordance with this invention is illustrated diagrammatically in FIG. 1. The processor 10 includes a series of processing stations 12, 14, 16, and 18 for processing sheets or strips of photosensitive material such as x-ray film sheets 20. The film sheet 20 is advanced along a path 22 through the various stations 12–18 for processing latent images on the film, and then drawing the film and delivering it to the user. More specifically, station 12 is preferably a developer station in which a developer solution is applied to the sheet of film, station 14 is a fix station at which a fixer solution is applied to the sheet of film for fixing the developed image, station 16 is a wash station for directing water to the surface of the film for removing residual fluids from the other stations, and section 18 is a dryer station in which heated air is directed against the surface of the film for drying the film.

Film processor 10 may be a processor of the kind disclosed in U.S. Pat. No. 4,994,840.

Figure 2:
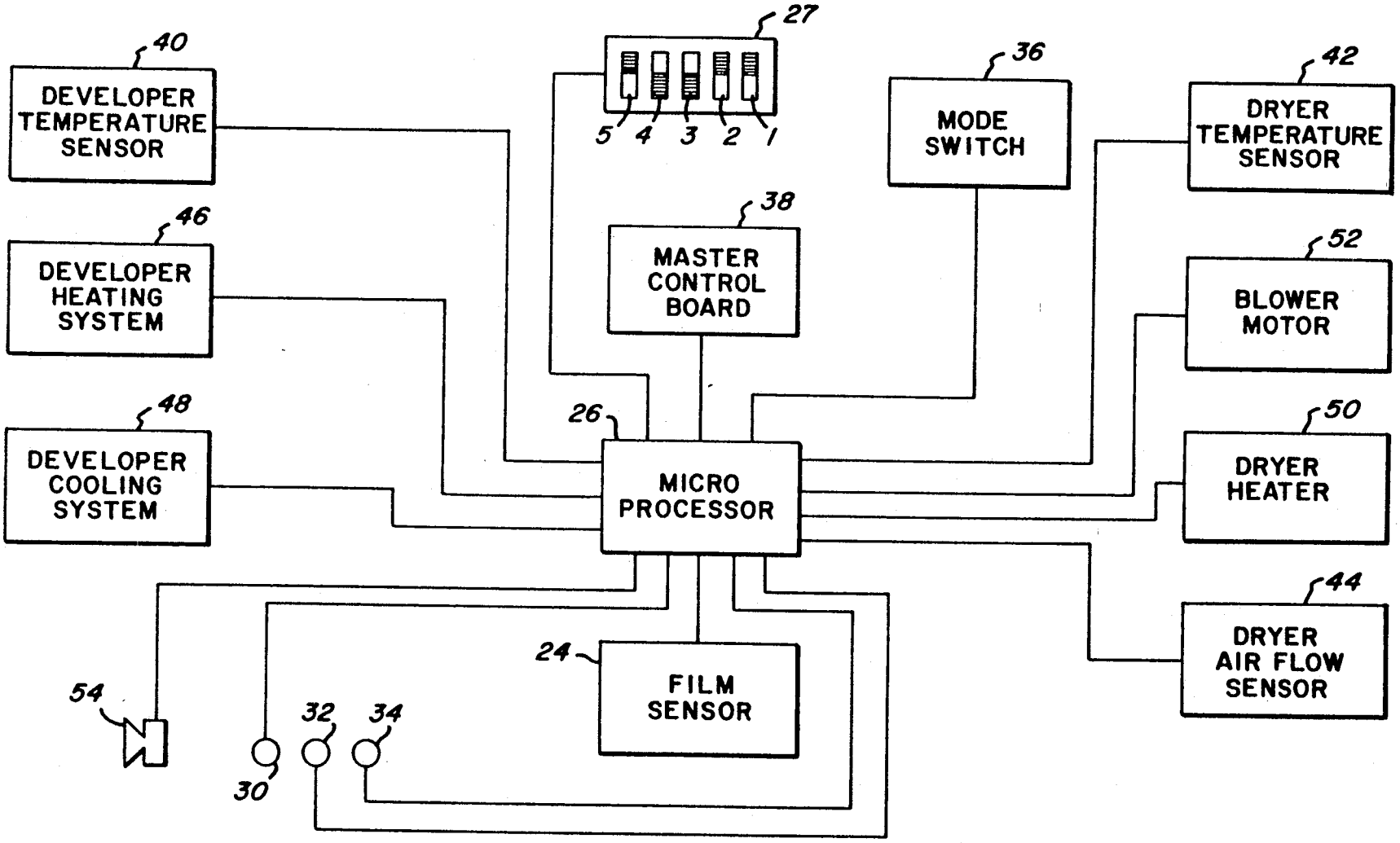
FIG. 2 is a schematic diagram of the control system of the processor in accordance with the invention.

The film processor 10 includes a plurality of pumps, heaters, heat exchangers, fans, and the like, for moving the film 20 through the various stations 12–18, maintaining the necessary solution temperatures, controlling the level of fluids in the stations, and drying the film. In order to simplify the drawing, these elements of the invention are not shown in FIG. 1, but are shown in FIG. 2, and will be described later.

As the film sheet 20 is fed into the processor, its presence is detected by one or more film sensors 24. Sensors 24 may comprise a light emitter and detector located on opposite sides of the film path, or the emitter and detector can be located in a common housing on one side of the path with light from the emitter being reflected from the film sheet into the detector.

The various elements of the film processor are preferably controlled by a microprocessor 26, which is coupled to each of the processing stations 12–18. The microprocessor senses the operating conditions in the stations and controls operation of the apparatus in each of the stations in a programmed manner, as will be described in more detail later. The film processor 10 has a control panel 28, that includes switches and other devices used by the operator for controlling operation of the processor, and lamps and other devices for indicating to the operator the various operating conditions of the processor. Three lamps, 30, 32, and 34 are shown on the control panel. Preferably, lamp 30 is a "ready" lamp which indicates to the operator when it is turned on that the processor is ready for operation and a sheet of film can be fed into the processor. Lamp 32 is a "wait" lamp which, when turned on, signals the operator to temporarily defer feeding film into the processor. Lamp 34 is preferably a service lamp that, when off, indicates that the processor is functioning normally and, when on, indicates the need for service and by a pattern of blinks, the nature of the trouble. The operation of the service lamp in particular is described in more detail in copending U.S. patent application Ser. No. 772,516, filed Oct. 7, 1991.

The "wait" lamp will be on when operating conditions in the stations 12–18, as sensed by the microprocessor indicate that the machine is not operable due to factors that are temporary, and not a result of a failure of a portion of the apparatus which requires a service technician. For example, when the processor is first turned on, the lamp 32 will be on during the period when fluids in the various stations are below or above normal operating conditions. These conditions are sensed by the microprocessor and adjusted, for example, by operating a heater or cooler, or controlling the operation of pumps for setting the level of fluids. Thus, the wait light is ordinarily on only for those conditions that are temporary, and can be adjusted during the normal start up and operation of the processor.

Lamp 34, on the other hand, is a so-called "service" lamp, which when turned on signals the operator that an error condition exists which requires correction by a service person, as described in more detail in the patent application mentioned before.

Microprocessor 26 receives input information from a number of sensors including sensors that detect operating conditions in the stations of the film processor. The microprocessor is also connected to the output devices mentioned before, so that the output devices can be controlled from the microprocessor in accordance with a program stored in the microprocessor.

The stored programs control a number of aspects of the operation of the processor. The microprocessor controls the set up of the film processor during the warm up time by adjusting the temperature and level of the fluids and signaling the operator that the processor is ready only when predetermined conditions are satisfied. The microprocessor controls the film processor during operation, by controlling the progress of the film sheet through the processing stations 12–18, adjusting the level of the processing fluids during operation, and controlling washing and drying of the developed film and delivering the film to the user. If during operation, an abnormality exists, the microprocessor will detect and identify the abnormality and signal the abnormality to the user by blinking the service light. If the user cannot correct the abnormality himself, and must summon a service person, the pattern of blinks can be used to identify the problem for the service person, to enable him to bring the necessary spare parts or the like to correct the problem.

During servicing, it is often helpful to isolate the source of a problem by performing predetermined diagnostic procedures, such as energizing a particular pump, fan, or motor in the processor to determine whether the pump, fan, or motor itself is functioning properly. Among the programs stored in microprocessor 26 are a plurality of diagnostic programs that operate the components of the film processor in predetermined ways, so that their functions can be checked by a service technician, while adjusting any mechanisms that need adjusting and diagnosing further problems. Most of these predetermined diagnostic procedures will simply actuate the various electromechanical assemblies of the processor, or turn on the various indicator lights. Some procedures will examine the state of the various sensors, and report this information to the service technician by way of the front panel indicator lights already described.

The diagnostic mode is accessed and the particular diagnostic test selected by setting the switches on a service switch pack 27 to indicate the diagnostic routine desired. One of the switches on the service switch pack is used to select the diagnostic mode, and the remaining switches are used to indicate the diagnostic procedure desired. Preferably, the service switch pack is located within an "electrical box" within the processor that is not normally accessible to a user. In order to select and run a service routine, the service technician opens the processor cover, opens the electrical box and changes the position of the diagnostic service switch to the on position. The service person then sets the remaining service routine selection switches to choose the desired diagnostic procedure. After the position of the selection switches has been stable for a predetermined period, such as five seconds, the processor will automatically run the requested diagnostic service routine. To select a second test, the service person sets the service routine selection switches to the correct positions for the desired test. When the microprocessor 26 senses a change in the service switches, it terminates the first test. When the new switch settings have been stable for the predetermined period, the second test is initiated.

When the service person has completed the testing, all of the switches are returned to the off position. When all of the switches have been off for more than a predetermined period, such as five seconds, the processor will reset. The electrical box is then closed, and the processor cover replaced.

Shown schematically in FIG. 2, the microprocessor 26 receives input information from a master control board 38. Generally, an error condition in the master control board renders the processor inoperative. Therefore, such an error condition has a high priority in terms of providing an error signal to the machine operator. Any error in the master control board ordinarily will not be repaired at the site of the processor, but instead the board will be replaced.

The microprocessor controls the operation of the subsystems of the film processor during normal use. In the developer station 12, the developer solution is maintained within a range of operating temperatures that enables the film to be properly processed. The temperature of the developer fluid is detected by a developer temperature sensor 40, which provides an input signal to the microprocessor 26, indicating the developer temperature at any time.

In the drying station 18, the temperature of drying air is detected by a dryer temperature sensor 42, which provides an input signal to the microprocessor 26, indicating the temperature in the dryer. Air is circulated in the dryer to heat and thereby dry the film. Therefore, a dryer air flow sensor 44 is provided for inputting a signal to the microprocessor 26, indicating that air is flowing in the dryer, or that air is not flowing for some reason. In a similar manner, other sensors (not shown) in stations 12, 14, 16, and 18 provide input signals to the microprocessor, so that the microprocessor can determine in accordance with the programmed information stored therein whether the processor is in condition for operation. Microprocessor 26 is also coupled to output devices for controlling the operation of the various stations, as described before. More particularly, for example, the microprocessor is shown connected to a developer heating system 46, and a developer cooling system 48. By controlling the operation of the heating system 46 and cooling system 48, the microprocessor can adjust and control the temperature of developer solution in the developer station 12.

The microprocessor is also connected to a dryer heater 50 and a blower motor 52 in the drying station. This enables the microprocessor to control the temperature of the air being circulated in the dryer, and to operate the motor for the blower which circulates air in the drying station. Similar output devices (not shown) located in the fixed station 14, and the wash station 16 are under control of the microprocessor.

As noted before, the microprocessor is connected to indicator lamps 30, 32, and 34, and turns them on or off to indicate a ready condition, a wait condition, and a service condition. Preferably, the service lamp 34 is turned on and off, that is blinked, in a sequence that signals a particular error code. The operation of the microprocessor in detecting and signaling error conditions is described completely in the patent application referred to above.

As mentioned before, the service technician will oftentimes need to either obtain more information or make adjustments to one or more of the processor systems. To assist him in doing so, instructions stored in the microprocessor 26 include a plurality of preprogrammed diagnostic tests for activating components of the film processor. For example, the preprogrammed tests can include operating the following processor assemblies:

Replenish pump motor;
Wash recirculation pump motor;
Dryer blower motor;
Dryer heater;
Developer heater;
Incoming wash water solenoid;
Developer cooling solenoid/diverter solenoid;
Wait, ready and service indicator lights.

The diagnostic test for each mechanism turns the requested mechanism on. The service technician can verify that the mechanism is operating, and make any necessary adjustments, and therefore eliminate the mechanism itself as a source of the malfunction.

To initiate a desired one of the diagnostic tests, the service technician uses the service switch pack 27. The service switch pack includes five switches. The switches are labeled 1–5 in FIG. 2. Switch 1 is a mode switch. When turned on, the mode switch places the processor in the diagnostic mode. The remaining switches 2–5 of the service switch pack select the desired diagnostic routine. Preferably, the microprocessor includes a software routine for continuously scanning the state of the switches. To initiate a test, the service technician moves switch one to the service position and sets switches 2–5 to select the desired diagnostic procedure. In addition to the mechanism actuation routines mentioned before, the processor is also able to read the following sensors:

Film detectors 1, 2, and 3;
Air flow detector switch;
Developer level detector switch.

The processor uses the indicator lights on the master control board 38 to indicate the status of the sensors. For example, when testing the film detectors, a single diagnostic procedure checks all three detectors. When no film is present, all three indicator lights are off. If detector 1 senses the presence of film, the ready indicator light will be turned on. If detector 2 senses the presence of film, the wait indicator light will be turned on, and if detector 3 senses the presence of film, the service indicator light will be turned on. In this way, any combination of the three detectors can be tested.

If the air flow detector switch is being tested, the dryer blower will be turned on at the same time, in order to provide air flow for actuating the switch. If the air flow detector switch or the developer level detector switch is being tested, all three indicator lights will be used to indicate the status of the switch. The preprogrammed diagnostic tests allow the service technician to isolate most foreseeable problems in the film processor, and to make the necessary repairs and adjustments to return the processor to operating condition.

In order to reduce the number of components as much as possible, the microprocessor includes a software routine for monitoring the status of the switches in the service switch pack. For example, in accordance with a presently preferred embodiment of the invention, the microprocessor software includes a timing routine. Rather than provide a separate switch for initiating a diagnostic routine, the timer routine in combination with a software routine that monitors the status of the switches in the diagnostic switch pack continuously monitors the time since the last change in a switch setting. When a predetermined time has elapsed with no switch being changed, for example five seconds, the timer routine generates an initiation signal to initiation means for starting the predetermined diagnostic test.

Depending on the nature of the test, the test will continue either indefinitely or until terminated. A diagnostic test may be terminated either by returning switch 1 to the off position, or by changing the setting of any of the switches 2–5 to designate another of the predetermined diagnostic tests. As soon as any switch is changed, the switch sensing routing generates a signal to terminate the then running diagnostic test, if any, and restart the timer routine. The operation then continues as described before, that is after no switch setting has been changed for five seconds, the new diagnostic test is initiated.

Once the service technician has restored the processor to operating condition, all of the switches are returned to the off position. A routine in the processor senses this and resets the processor. Preferably, to ensure that the processor is ready to process film after any necessary service has been completed, if the processor cover is not replaced before the processor reset occurs, the processor will enter a replenishment check mode to calibrate the replenishment system. Replenishment check mode is used to "calibrate" the replenishment system.

While the invention has been described in connection with a presently preferred embodiment thereof, those skilled in the art will recognize that many modifications and changes may be made therein without departing from the true spirit and scope of the invention, which accordingly is intended to be defined solely by the appended claims.

What is claimed is:

1. In a processor for developing latent images on a photosensitive material, the processor having at least one processing station wherein a processing solution engages the material and a drying station wherein the material is dried, means for initiating a plurality of diagnostic tests for activating components of the processor, the improvement comprising:

control means coupled to the components of the processor for selectively activating one or more of the components according to a selected one of a plurality of predetermined diagnostic tests;

switch means connected to the control means for selecting from among the plurality of diagnostic tests;

initiation means for starting the selected test a predetermined time after the switch means are set; and in which the control means includes means responsive to the switch means for terminating a diagnostic test and resetting the initiation means when the switch means is changed to select another diagnostic test.

2. The processor of claim 1 wherein the control means comprises a programmed microprocessor and interface means connected between the microprocessor and the components for activating the components upon receiving activation signals from the microprocessor.

3. The processor of claim 2 wherein the switch comprises a plurality of switches connected to the microprocessor, the selection depending on the setting of the plurality of switches.

4. The processor of claim 2 wherein the switches comprise single pole single throw switches.

5. The processor of claim 4 in which the switches are arranged to signal a binary code and the microprocessor reads the code from the switches.

6. The processor of claim 5 in which the binary code uniquely identifies one of the diagnostic tests.

7. The processor of claim 8 also comprising a switch for selecting between a diagnostic mode and a normal mode.

8. The processor of claim 1 also comprising a plurality of sensors and a plurality of indicators, wherein the plurality of diagnostic tests comprises at least one test in which the indicators are configured to indicate the status of the sensors.

9. In a method for processing latent images on a photosensitive material including the steps of developing the image with the developer solution, fixing the developed image with a fixed solution, washing the material to remove processing solution therefrom, drying the material, the improvement for individually trouble shooting a plurality of components comprising the steps of:

pre-programming a plurality of diagnostic tests;

providing plurality of switches for selecting one test from the plurality of pre-programmed tests;

monitoring the state of the switches to determine whether the state has changed during a predetermined period; and initiating a test according to the setting of the switches after the predetermined period has passed since a last change in state of any of the switches.

10. In a method for processing latent images on a photosensitive material including the steps of developing the image with the developer solution, fixing the developed image with a fixed solution, washing the material to remove processing solution therefrom, drying the material, the improvement for individually trouble shooting a plurality of components comprising the steps of:

providing a plurality of switches;

monitoring the state of the switches to determine whether the state has changed during a predetermined period; and initiating a test according to the setting of the switches after the predetermined period has passed since a last change in state of any of the switches; and terminating a test if the state of the switches changes during the test.

11. The method of claim 10 comprising repeating the monitoring and initiating steps after the termination.

12. The method of claim 9 in which providing a plurality of switches comprises providing a mode switch and a plurality of selector switches and said monitoring step comprises monitoring the state of said mode switch to determine whether to initiate a diagnostic mode, and monitoring the state of the selection switches to select a diagnostic test from a plurality of diagnostic tests.

* * * * *